US005534064A

United States Patent [19]

Tsutsui et al.

[11] Patent Number: 5,534,064

[45] Date of Patent: Jul. 9, 1996

[54] SUPPLYING METHOD OF POWDER PAINTS TO COATERS AND POWDER COATING MACHINE CAPABLE OF PULVERIZING POWDER PAINT PELLETS INTO A SPRAYABLE POWDER

[75] Inventors: Koichi Tsutsui, Kyoto, Japan; Samuel A. Rhue, Rocky River, Ohio

[73] Assignee: Nippon Paint Co., Ltd., Osaka, Japan

[21] Appl. No.: 461,776

[22] Filed: Jun. 5, 1995

Related U.S. Application Data

[63] Continuation of Ser. No. 123,469, Sep. 20, 1993, abandoned.

[51] Int. Cl.[6] ..... B05B 7/14

[52] U.S. Cl. ..... 118/308; 118/608; 118/610; 118/612; 241/39

[58] Field of Search ..... 241/5, 39, 68, 241/69; 118/608, 610, 612, 308

[56] References Cited

U.S. PATENT DOCUMENTS

| | | | |
|---|---|---|---|
| 2,100,848 | 11/1937 | Hardgrove . | |
| 2,179,665 | 11/1939 | Martinet . | |
| 3,960,323 | 6/1976 | Ducan et al. . | |
| 3,970,035 | 7/1976 | Birckhead, Jr. . | |
| 3,994,157 | 11/1976 | Burk et al. | 73/94 |
| 4,413,788 | 11/1983 | Schaefer et al. . | |
| 4,592,302 | 6/1986 | Motoyama et al. | 241/39 |
| 4,734,451 | 3/1988 | Smith | 118/308 |
| 4,789,569 | 12/1988 | Douche et al. | 118/308 |
| 4,815,414 | 3/1989 | Duffy et al. | 118/308 |
| 4,934,613 | 6/1990 | Kukuch | 241/39 |
| 5,035,364 | 7/1991 | Escallon . | |
| 5,143,303 | 9/1992 | Niemi | 241/39 |
| 5,147,746 | 9/1992 | Ohta | 430/106 |
| 5,159,765 | 11/1992 | Kramer | 34/57 R |

FOREIGN PATENT DOCUMENTS

| | | | |
|---|---|---|---|
| 102061 | 3/1985 | European Pat. Off. . | |
| 382028 | 1/1990 | European Pat. Off. . | |
| 452220 | 12/1966 | France . | |
| 314775 | 1/1977 | France . | |
| 5256201 | 10/1993 | WIPO | 118/308 |

*Primary Examiner*—James C. Housel
*Assistant Examiner*—Rachel Heather Freed
*Attorney, Agent, or Firm*—Townsend & Banta

[57] ABSTRACT

Supplying method of powder paints wherein powder paint pellets are manufactured and stored as they are at the manufacture site and, when ordered, they are shipped and transported to the coater, and, at the coater site, they are stocked, and pulverized and classified into a sprayable powder upon powder coating thereby enabling to control the particle size of the powder paint while continuing the powder coating.

A powder coating machine therefor pulverizes and classifies powder paint pellets into a sprayable powder at the coater site while continuing powder coating using the pulverized powder paint.

20 Claims, 7 Drawing Sheets

SUPPLYING METHOD OF POWDER PAINTS TO COATERS AND POWDER COATING MACHINE CAPABLE OF PULVERIZING POWDER PAINT PELLETS INTO A SPRAYABLE POWDER

CROSS REFERENCE TO A RELATED APPLICATION

This is a file wrapper continuation application of application Ser. No. 08/123,469 filed Sep. 20, 1993, now abandoned.

BACKGROUND OF A INVENTION

1. Field of the Invention

The conventional method for producing powder coatings as shown in FIG. 12 consists of weighing and mixing the powder coating ingredients, then extruding the mixture to obtain a homogeneous melt mixed product. The melt mix is compressed into a sheet form, cooled, flaked, then ground into a powder form which is passed through a screener to remove oversize particles prior to packaging.

2. Description of the Related Art

The average particle size of coating powders for electrostatic spray applications as supplied by the powder coating manufactures, generally range from twenty-five to fifty microns. Any given powder coating product will be ground to a specific average particle size (e.g. 35 microns) and ultimately be shipped to various coaters for application. Each coater, however, may require a slight to vastly different particle size than that supplied in order to achieve a desired thickness and/or appearance. Each commercial powder coating application system may also perform better with a particle size different than that supplied by the powder coating manufacturer.

The disadvantage of this method is that some powder paints are apt to sinter during transporting to the customers site or during storage. The sintering phenomenon occurs when the ambient temperature is high and too close to the glass transition (Tg) point of the base resin system utilized in the coating or the particle size of the ground powder is too fine (<20μ). This could necessitate the need to store the powder in refrigerated rooms.

In fact, according to an experiment by the present inventors, sintering phenomon was observed when a low Tg (=45° C.) powder coating with mean particle size 30 μm having a composition of glycidyle group contained acrylic resin 100 gr., decane di-carboxylic acid 25 gr. and an additive agent 1 gr. and super-fine powder coating with mean particle size 10 μm having the substantially identical composition except for Tg=55° C. of the resin were kept at 35° C. for two months.

The grinding-at-the-gun technique allows the chip (flake) that is formed after the extrusion process to be packaged and sent directly to the coating site. The term, pellet, chip or flake, refers to the extruded powder coating mixture that has been compressed into a thin sheet, cooled to below the melt-mix freeze point and broken into small chip form by means of a mechanical crusher.

SUMMARY OF THE INVENTION

An object of the present invention is therefore to provide a supplying method of powder paints capable of making temperature control unnecessary for the powder paints during custody and/or transportation thereof, thereby facilitating the use of lower Tg powder paints for better powder coating.

Another object of the present invention is to provide a powder coating machine capable of directly processing powder paints in the form of pellets for powder coating without pulverizing them beforehand.

A further object of the present invention is to provide a system allowing the coater to tailor the particle size of the powder coating to fit the immediate application need.

One more object of the present invention is to provide a system capable of performing tighter control of film build at the coater site.

In order to achieve these objects, according to the present invention, there is provided a supplying method of powder paints comprising steps of storing powder paints in a chip form at the manufactory site, shipping and transporting said powder paints in a chip form to the coater when ordered, storing said powder paints in a chip form at the coater site pulverizing said powder paints to be coated into a powder state and supplying pulverized powder paints to the application site.

According to this method, the manufacturer can store powder paints in a form of pellet and ship them as they are and, thereby, costs necessary for keeping in custody and transportation of powder paints is greatly reduced.

On the other hand, users also can receive great merits in keeping the stocked powder paints in custody and handling them.

According to another aspect of the present invention, there is provided a powder coating machine capable of pulverizing powder paint pellets into a sprayable powder comprising a feeding means for feeding said powder paint pellets; a pulverizing means for pulverizing said powder paint pellets fed by said feeding means; into a sprayable powder; a powder coating means; and a transporting means for transporting said sprayable powder from said pulverizing means to said powder coating means.

It is desirable to provide a classify means for classifying the pulverized powder paints in order to control the particle size at the coater site.

In this powder coating machine, each user can handle powder paints in a form of pellet just before beginning powder coating and only thing to be done by an operator is to supply powder paints weighed beforehand to the machine. Thus, handling of powder paints is extremely simplified.

BRIEF DESCRIPTION OF THE DRAWINGS

These and other objects and features of the present invention will become clear from the following description taken in conjunction with the preferred embodiments thereof with reference to the accompanying drawings throughout which like parts are indicated by like reference numerals, and in which.

DETAILED DESCRIPTION OF THE PREFERRED EMBODIMENTS

Figure 1:
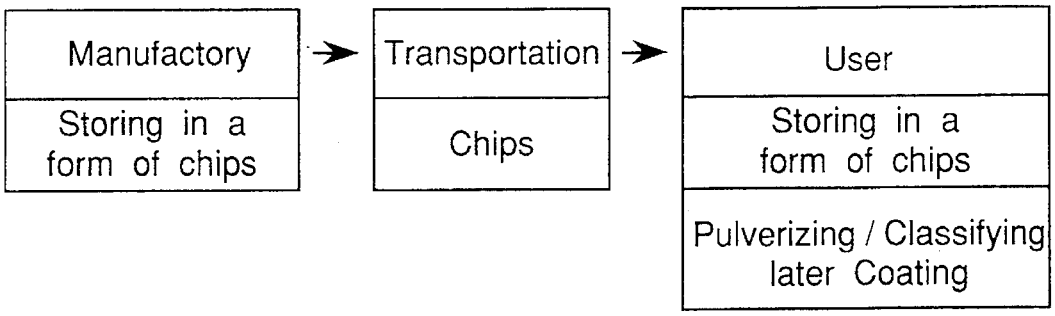
FIG. 1 is a block diagram for showing a supplying and processing method of powder paints according to the present invention.

FIG. 1 shows a flow chart of supplying and processing powder paints according to the present invention.

As shown in FIG. 1, a manufactory keeps powder paints manufactured in a form of pellet, chip or flake (hereinafter referred to as pellet) in custody. In other words, powder paints are kept in custody in a manufactured state not in a pulverized state. Thus, the manufactory can stock powder paints with a relatively small volume without necessity of severe temperature control.

When ordered from a user, the manufactory ships ordered powder paints in a form of pellet to the user. As is clear from comparison with the conventional case shown in FIG. 7, transportation can be far simplified since it becomes unnecessary to keep them under a cooling condition and the volume necessary for transporting them becomes quite small when compared to a powder state.

The user stocks the forwarded powder paints in a form of pellet as they are.

The user pulverizes and classified some of the stocked powder paints according to a schedule of production beforehand and, keeps the pulverized and classified powder paints in a powder state using appropriate containers such as cans.

The user supplies stocked powder paints, while controlling individual volumes of them, to a powder coating gun to execute a powder coating.

Figure 2:
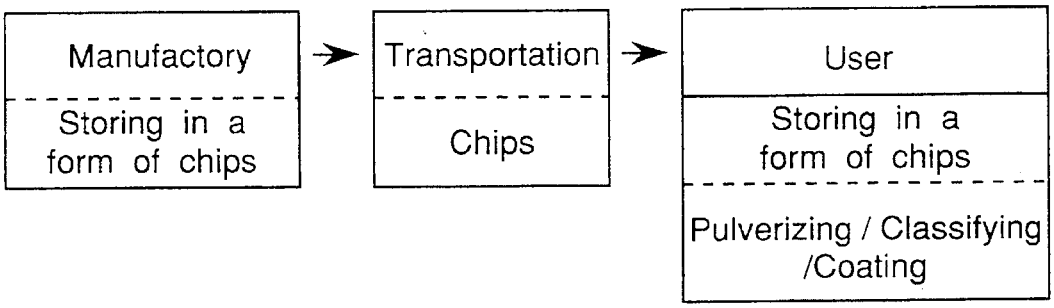
FIG. 2 is a block diagram for showing another supplying and processing method of powder paints according to the present invention.
Figure 12:
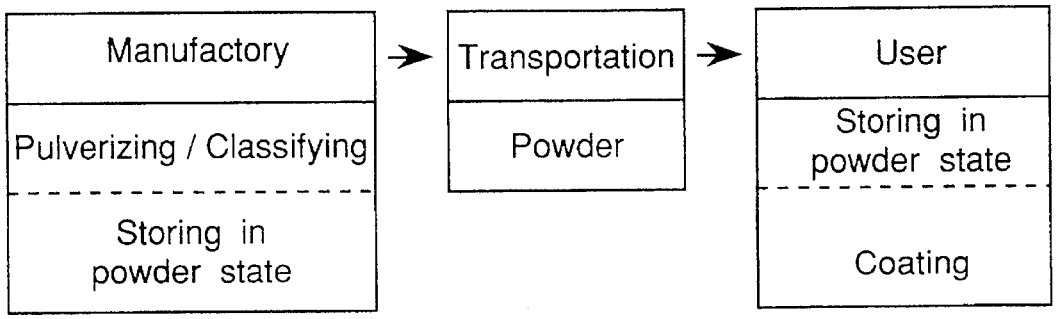
Fig.12 PRIOR ART
FIG. 12 is a block diagram for showing a conventional supplying method of powder paints.

FIG. 2 shows another embodiment of the present invention wherein the user stocks powder paints in a delivered state, namely, in a form of pellet.

Upon powder coating, the user pulverizes necessary amounts of powder paints stocked in a form of pellet and continuously feeds pulverized powder paints to a powder coating gun while classifying them. Namely, in the present embodiment, the powder coating is done while pulverizing and classifying the powder paints.

Thus, in this embodiment, nothings are needed for controlling stock conditions of pulverized powder paints as are needed in the embodiment of FIG. 1.

Figure 3:
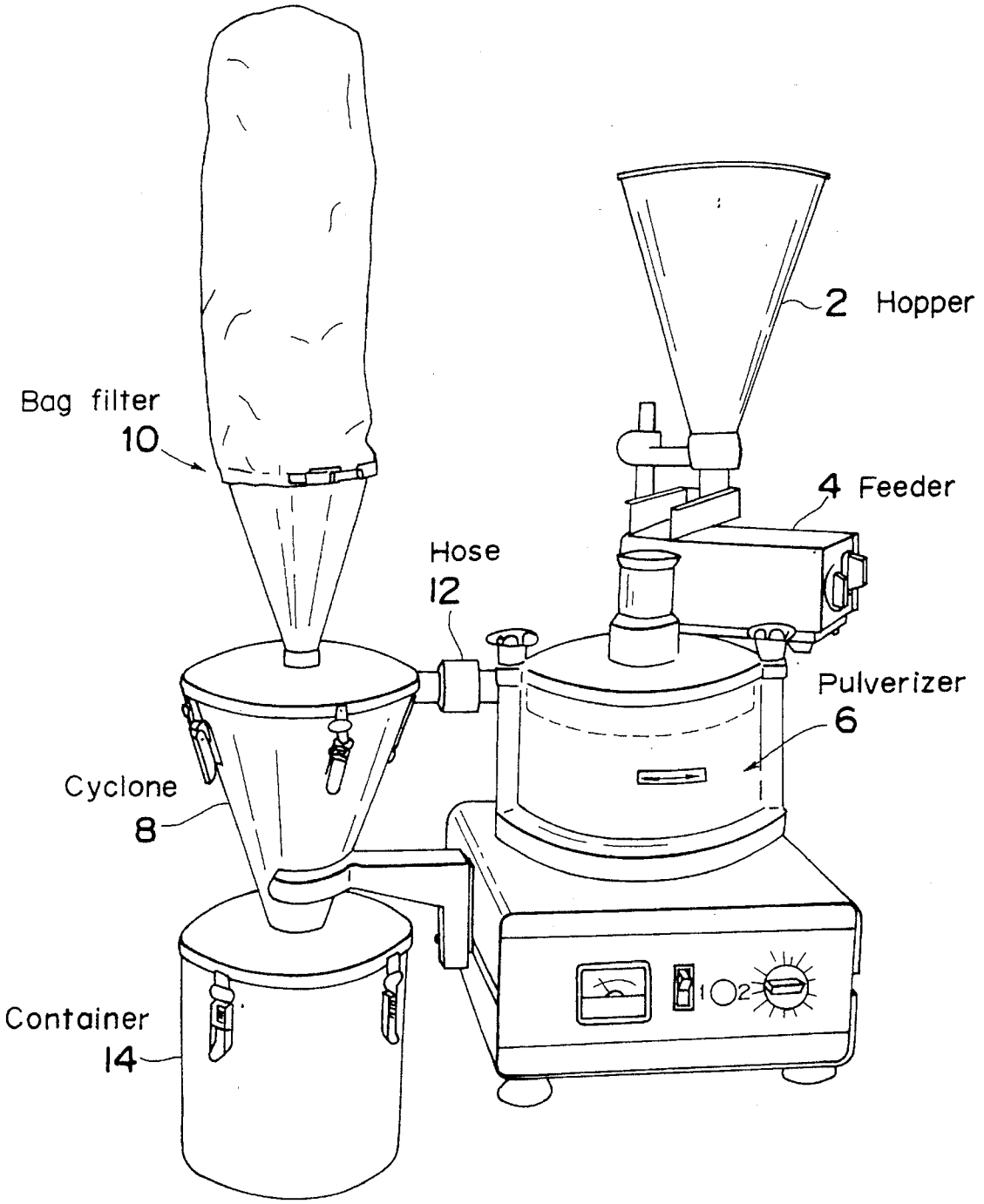
FIG. 3 is a perspective view of the pulverizing and classifying machine of powder paints according to the present invention.

FIG. 3 shows a pulverizing and classifying machine of powder paints in a form of pellet which is provided at the user site.

This machine comprises a hopper 2 for supplying powder paint pellet, a pellet feeder 4 for feeding a predetermined amount of powder paint pellet supplied from the hopper 2, a pulverizer 6 for pulverizing the powder paint pellet fed from the pellet feeder 4, a cyclone 8 with a bag filter 10 for classifying powder paint pulverized by the pulverizer 6 and sucked therefrom through a hose element 12 connecting the upper portion of the pulverizer 6 with the upper portion of the cyclone and a container 14 for containing classified powder paint therein.

Figure 4:
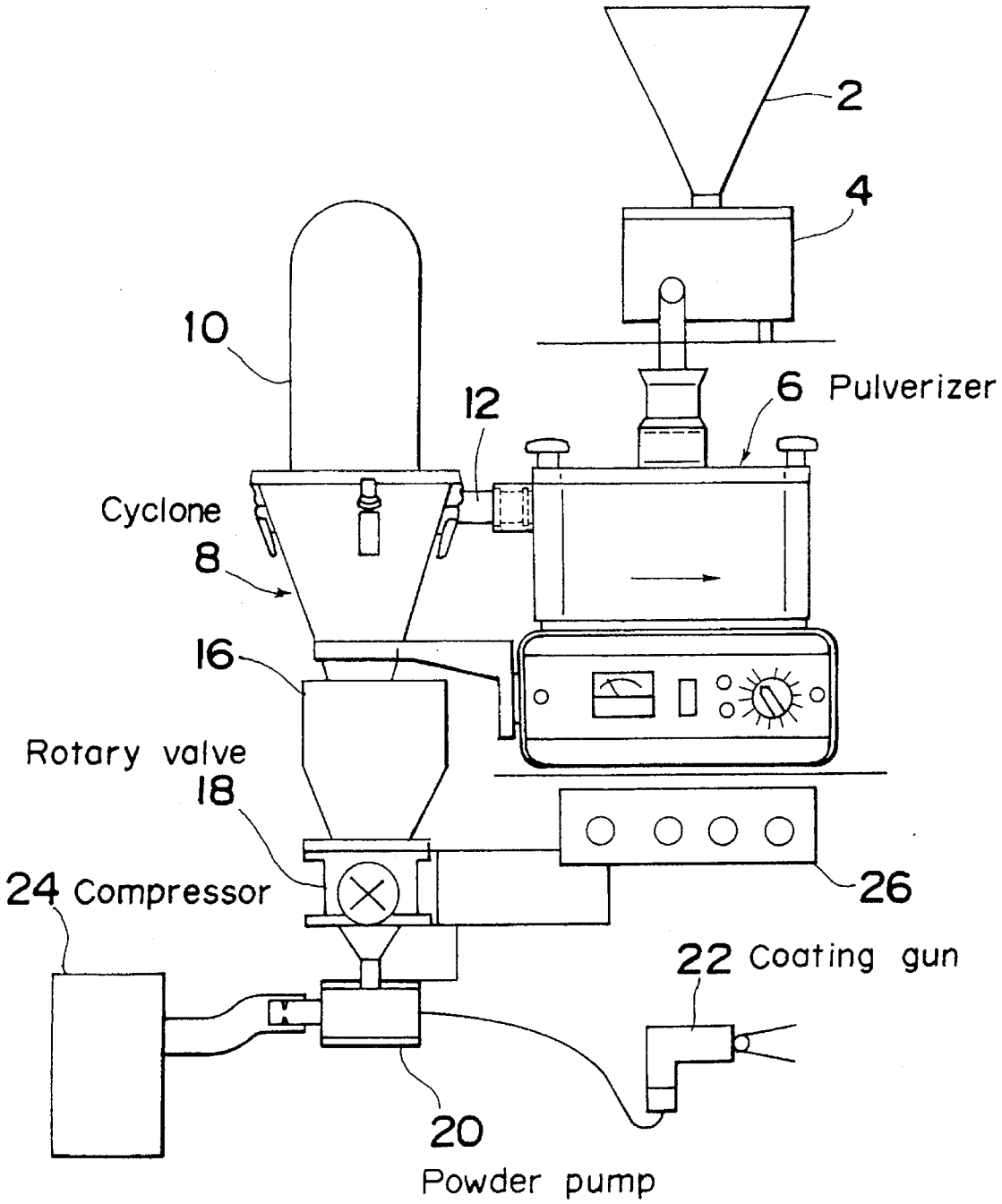
FIG. 4 is a schematical front view of the powder coating machine according to the present invention.

FIG. 4 shows a powder coating machine developed further from the machine of FIG. 3 which is capable of powder coating while pulverizing and classifying powder paint pellet.

In this machine, there is arranged a container 16 with a rotary valve 18 beneath the cyclone 8. The container 16 contains powder paint classified by the cyclone 8 and the rotary valve 18 transports the powder paint to a powder pump 20 at a constant flow rate. The powder pump 20 supplies the same to a powder coating gun 22 by compressed air supplied from an air compressor 24. A controller 26 is provided to control operation of the powder coating machine.

Other elements denoted by reference numerals 2, 4, 6, 8, 10 and 12 are substantially same as those of the machine shown in FIG. 3.

Any kinds of known feeders such as rotary feeder and the like which are electrically controllable can be used for the feeder 4 of the powder paint pellet.

Figure 5:
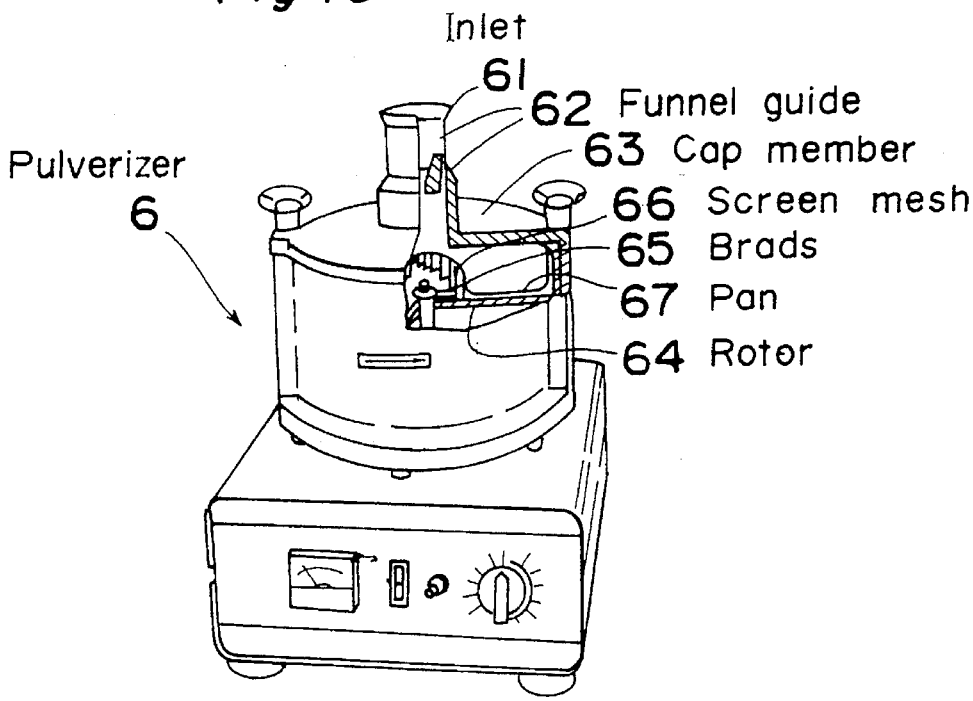
FIG. 5 is a partially cut perspective view of the mill for pulverizing powder paints in a form of pellet according to the present invention.
Figure 6:
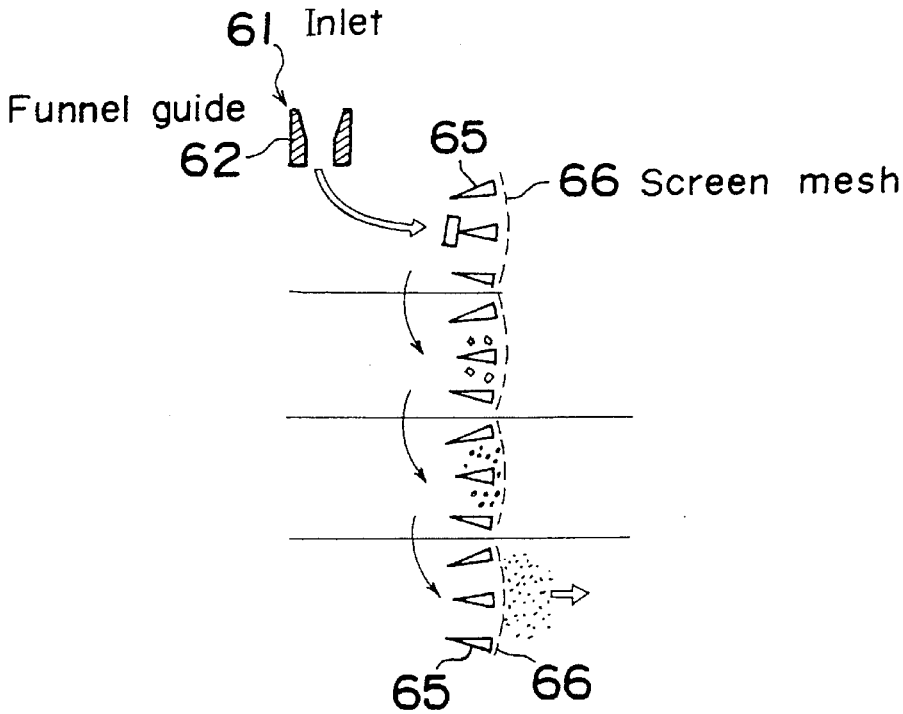
FIG. 6 is an explanatory plan view for showing the principle of pulverizing powder paints according to the mill shown in FIG. 5.

The pulverizer 6 shown in FIG. 3 and FIG. 4 has a structure as shown in FIGS. 5 and 6. Powder paint pellet thrown into an inlet 61 with a funnel guide 62 provided at the center of a cap member 63 drops on a rotor 64 rotating at a high speed. The rotor 64 has brads 65 arranged radially and surrounded by a cylindrical screen mesh 66. The powder paint pellets thrown into collide with the brads 65 at a high speed by a centrifugal force and, thereby, primarily pulverized by cutting, shearing and/or hitting. Primarily pulverized particles are further pulverized into powder between the screen mesh 66 and the brads 65 of the rotor 64 by breakage action due to air gaps and/or vortex of air generated therebetween. The powder thus formed is collected by a ring-like pan 67 by passing through the screen mesh 66 by a centrifugal force.

It is to be noted that various types of the pulverizing mill being on the market are applicable to the pulverizer according to the present invention as far as they can pulverize resin powder paints in a form of pellet into powder having an average radius of 5 μm to 100 μm or so. For example, as a high speed rotating mill "TURBO-MILL" manufactured by TURBO KOGYO CO., LTD. of Yokosuka-shi, Kanagawa-ken, 239 Japan, "ACM PULVERIZER" offered by HOSOKAWA MICRON CORPORATION of Osaka, 541 Japan, "Air Swept Pulverizer" offered by Jacobson Inc. Minneapolis, U.S.A, "SQUIRREL MILL" offered by Fuji Paudal Co., LTD. of Osaka, 536 Japan and "KOSMOS" kryptron offered by Kawasaki Heavy Industry Co., LTD. of Tokyo, 105 Japan and, as a jet mill "SUPER SONIC JET MILL" offered by NPK of Nabari-shi, Mie-ken, 518 Japan, are applicable for the pulverizer. Some of the mills recited above provide a classifier for classifying pulverized powder paint. In such a case, the extra classifier can be omitted.

The operating principle of the cyclone and its structure are well known to those skilled in the art.

As to the classifying means, vibrating screen, rotary screen, air-shifter, air-flow separator like "Turbo-centrifugal separating screen" manufactured by Powtek, U.S.A., "Dispersion separator" by NPK, "Micron separator" by Hosokawa, "Tornade shifter" by NPK and the like can be used.

The rotary valve 18 and the powder pump 20 as the transporting means of powder coatings are also well known to those skilled in the art.

As to the transporting means from the mill to the coating gun, air blower means, mechanical conveyer means or the like is also usable.

As to the powder coating gun 22, various guns being on the market, for example Matsuo-Gema's tribo electric powder coating gun offered by Matsuo-Gema of Osaka, 542 Japan, and corona discharge powder coating gun like Onoda Gun offered by Onoda Cement Co., Ltd. of Tokyo, 135 Japan, "STAGE JRN 404" offered by Sames of France and the like, are available therefor.

It is also to be noted that the present invention is applicable for various powder coating machines utilizing corona discharge electrification method, electrification coating method belonging to the contact electrification method, fluidized bed coating method and the like.

Figure 7:
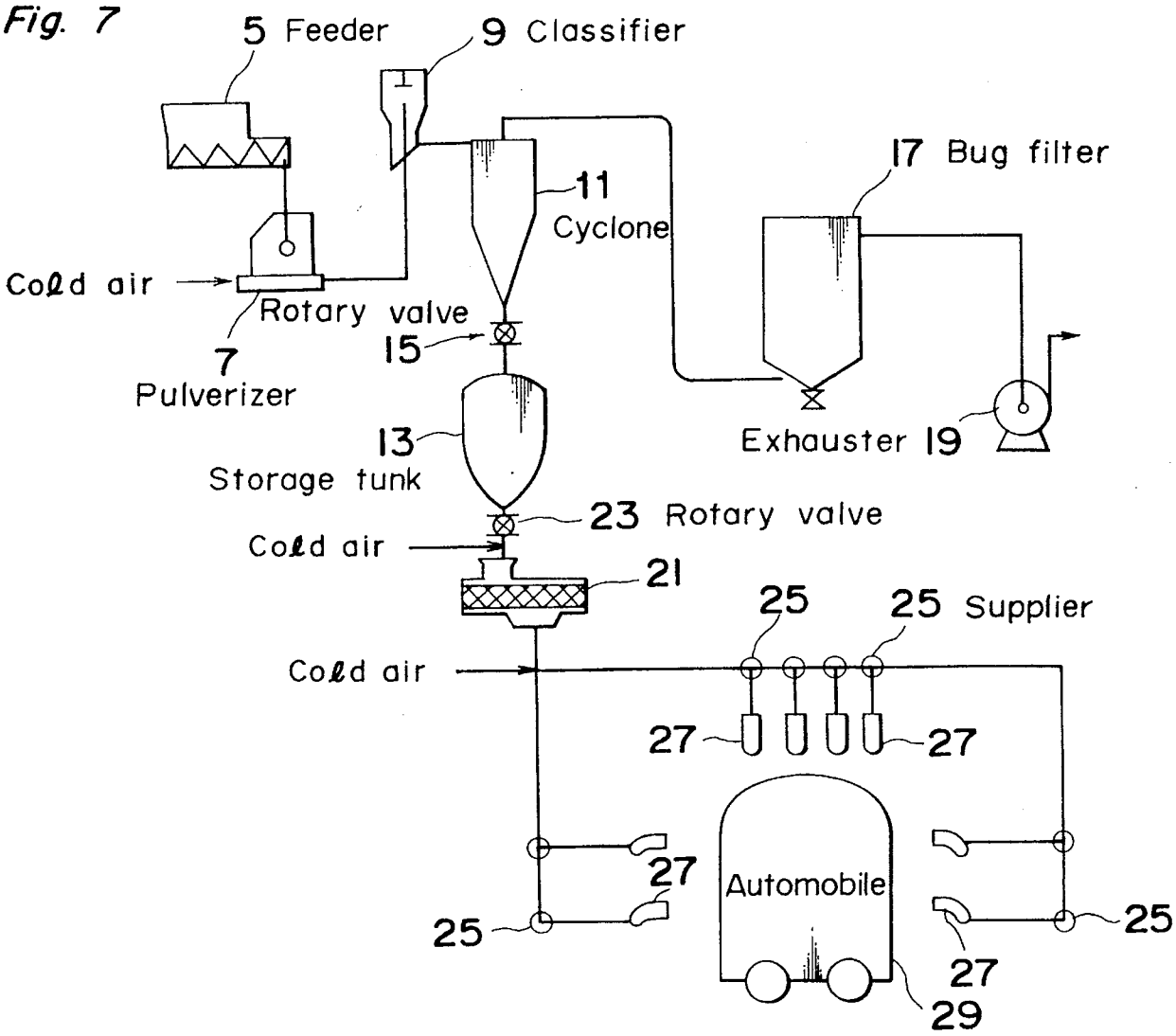
FIG. 7 shows a flow chart of the powder coating system according to the present invention.

FIG. 7 is a flow chart of the powder coating line according to the second preferred embodiment of the present invention.

In this powder coating line, a feeder 5 such as a rotary feeder, a screw feeder, a table feeder or the like feeds powder paint in a form of pellet to a pulverizer 7 at a predetermined feeding rate, into which compressed cold air is supplied for cooling to powder paint pulverized thereby and feeding the same to a classifier 9 for classifying the pulverized powder paint.

The classified powder paint is fed to a cyclone 11 to capture the same therein. The captured powder paint captured by the cyclone 11 is fed to a storage tank 13 by a rotary valve 15 arranged at the bottom of the storage tank 13. This storage tank 13 has to be kept at a temperature of 5° to 10° C. to prevent the captured powder paint from blocking due to dead load and/or a high temperature. Powder paint not captured by the cyclone 11 is fed to a bug filter 17 and captured thereby according to a suction force exerted from an exhauster 19.

The powder paint stored in the storage tank 13 is fed to a shifter 21 having a screen for removing blocked powder paint, i.e. over-size particles, for instant a vibrating screen, a rotary shifter or the like, together with cool air by a rotary valve 23.

The powder paint passing through the shifter 21 is fed to a plurality of suppliers 25 together with cool air. Each supplier 25 provides with a tank having a small volume to receive the fed powder paint and supplies the same to a powder coating gun 27 connected thereto.

In this example, eight powder coating guns 25 are provided for powder-coating an automobile 29.

Figure 8:
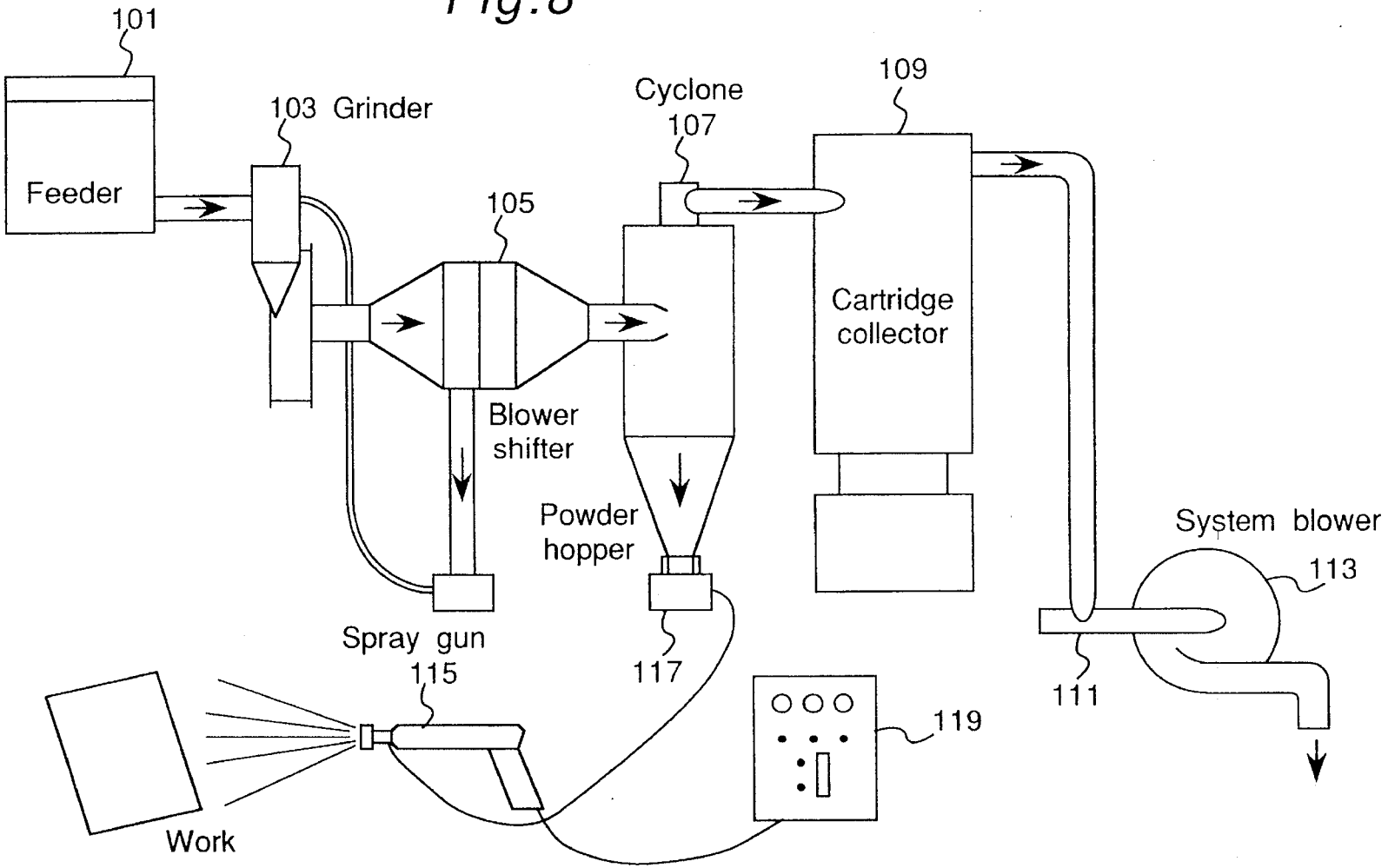
FIG. 8 is a block diagram of a powder coating equipment according to a third embodiment of the present invention.

FIG. 8 shows a third preferred embodiment of the present invention.

The pulverizing and classifying machine for grinding powder coatings at the user site consists of;

feeder 101 for feeding powder paint pellets;

grinder 103 for grinding powder paint pellets fed by the feeder 101 which can be a hammer mill, pin mill, air classifying or jet mill;

blower shifter 105 for shifting the ground powder paint;

cyclone 107 as a classifying means;

cartridge collector 109 for collecting ultra-fine particles not captured in the cyclone 103, and system blower 113 for generating a sucking force in this system through a damper 111.

The process for converting pellets to a sprayable powder is conducted in the following manner.

A volume of powder pellets is loaded into the feeder 101 which controls the rate of feed to the grinding mechanism 103. The grinding mechanism 103, which may be a hammer, pin or jet mill, must be capable of varying the particle size of the powder being ground either through an external adjustment (e.g. rotor speed) or internal part replacement (e.g. grinding screen size). The ground powder is then drawn from the mill 103 by means of a blower assembly 113. As powder is drawn from the mill, it passes through a blower/shifter 105 to remove coarse particles. The powder then passes through the cyclone 107 which removes fine particles while allowing the remaining powder to drop into a spray gun powder hopper 117 arranged at the bottom of the cyclone 107. The powder is then transported to the spray gun 115 via a powder pump (not shown in FIG. 8) mounted on the powder hopper 117. The entire process is triggered by the spray gun 115 through a powder control 113 with a brief time delay to the feeder 101 which allows the system to reach equilibrium before the pellet feed begins. The cartridge collector 109 is inserted between the cyclone 107 and system blower 113 to capture fine particles (< 5 μm) which escape the cyclone thus preventing the blower fan 113 from plugging.

Figure 9:
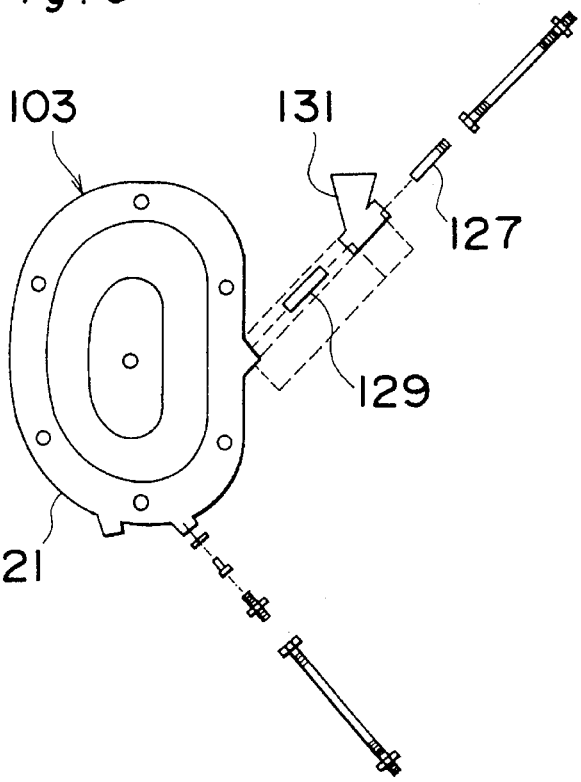
FIG. 9 is a partially disintegrated side-elevational view of the grinder shown in FIG. 8.
Figure 10:
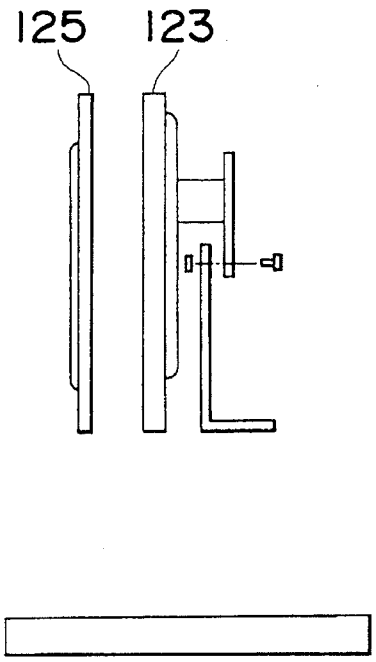
FIG. 10 is a partially disintegrated front view 10 of the grinder shown in FIG. 8.
Figure 11:
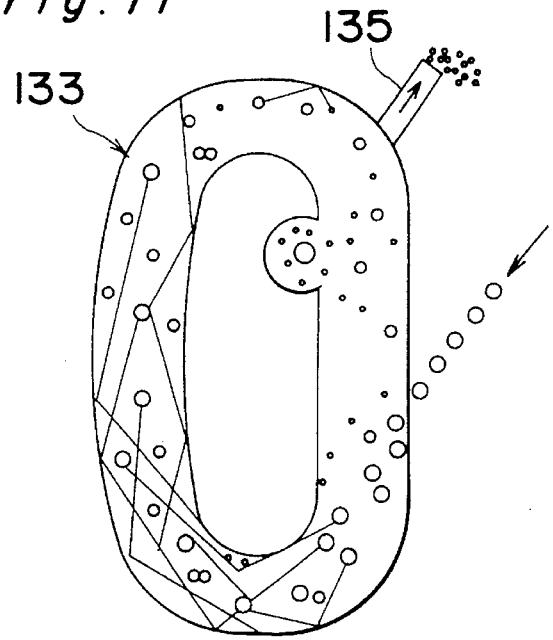
FIG. 11 is an explanatory plan view for illustrating the grinding principle of the grinder shown in FIG. 8.

FIGS. 9, 10 and 11 show the grinding mill 103 capable of reducing pellets to the powder form. In this machine pressurized air is introduced into a manifold 121 consisting of a mill body 123 and mill cover 125 through a pusher nozzle 127 and venturi nozzle 129 and pellets contained in a feed hopper 131 are drawn into the manifold by a venturi negative pressure generated by the venturi nozzle 129. The air introduced in the manifold is discharged into a reduction chamber 133 formed therein at sonic or supersonic velocity. Fed material (pellets) entering the reduction chamber 133 is entrained by the stream of circulating fluid. The violent jet action in the reduction chamber 133 breaks up the individual particles by impact against each other. The particles are carried upstack to the classifier inlet and around the classifier. Centrifugal force shifts the larger heavier particles to the outer periphery where, due to inertia, they continue down stack and re-enter the grinding chamber for further grinding. At the classifier some of the air changes direction and carries the fine particles from the mill through a classifier outlet 135.

Although the present invention has been fully described in connection with the preferred embodiments thereof with reference to the accompanying drawings, it is to be noted that various changes and modification are apparent to those skilled in the art. Such changes and modifications are to be understood as included within the scope of the present invention as defined by the appended claims unless they depart therefrom.

What is claimed is:

1. A powder coating machine for pulverizing paint pellets into a sprayable powder comprising:

supply means for supplying paint pellets;

feeding supply means for feeding said paint pellets from said supply means;

pulverizing means for pulverizing said paint pellets from said feeding means into powder;

classifying means for receiving and for classifying said powder from the pulverizing means into over-size particles and sprayable powder particles;

collection means for collecting and storing said sprayable powder particles from said classifying means;

powder coating means; and transporting means for transporting said sprayable powder particles from said collection means to said powder coating means.

2. The powder coating machine according to claim 1 wherein said feeding means is a screw feeder.

3. The powder coating machine according to claim 1 wherein said feeding means is a table feeder.

4. The powder coating machine according to claim 1 wherein said pulverizing means comprises a rotation mill.

5. The powder coating machine according to claim 1 wherein said pulverizing means comprises a jet mill.

6. The powder coating machine according to claim 1 wherein said feeding means comprises an air blower which generates a suction force for feeding said sprayable powder particles from said pulverizing means to said powder coating means through said transporting means.

7. The powder coating machine according to claim wherein said feeding means comprises an air compressor which generates compressed air for feeding said sprayable powder particles from said pulverizing means to said powder coating means.

8. The powder coating machine according to claim 1 wherein said powder coating means comprises a coater utilizing the corona discharge electrification coating.

9. The powder coating machine according to claim wherein said powder coating means comprises a coater utilizing the tribo electric powder coating.

10. The powder coating machine according to claim 1, wherein said classifying means comprises a vibration screen.

11. The powder coating machine according to claim 1, wherein said classifying means comprises an air classifier.

12. The powder coating machine according to claim 1, wherein said classifying means comprises a cyclone.

13. The powder coating machine according to claim 1, wherein said collecting means comprises a cyclone.

14. The powder coating machine according to claim 1, wherein said collecting means comprises a cartridge collector.

15. A powder coating machine according to claim 1, further comprising cold air feed means for supplying compressed cold air to said pulverizing means to cool said powder produced by said pulverizing means.

16. A powder coating machine according to claim 1, further comprising cooling means for cooling said sprayable powder particles in said collecting means.

17. A powder coating machine according to claim 1, further comprising shifter means receiving said sprayable powder particles from said collecting means to remove said over-size particles.

18. A powder coating machine according to claim 1, wherein said powder coating means comprises a spray gun.

19. A powder coating machine according to claim 18, wherein said transporting means comprises a cool air supply means for carrying said sprayable powder particles to said spray gun.

20. A powder coating machine according to claim 1, wherein said paint pellets are obtained from an extruded powder coating mixture that has been compressed into a sheet, which sheet is cooled to below the melt-mix freeze point, and then broken to thereby obtain said paint pellets.

* * * * *